US006494072B2

(12) United States Patent
Tittmann

(10) Patent No.: US 6,494,072 B2
(45) Date of Patent: Dec. 17, 2002

(54) METHOD OF AND DEVICE FOR FORMING A CLUTCH GEAR TOOTHING ON GEARWHEELS FOR CHANGE SPEED GEARS

(75) Inventor: Uwe Tittmann, Veilau (DE)

(73) Assignee: PSW Press-und Schiedewerk GmbH, Brand-Erbisdorf (DE)

( * ) Notice: Subject to any disclaimer, the term of this patent is extended or adjusted under 35 U.S.C. 154(b) by 0 days.

(21) Appl. No.: 09/778,903

(22) Filed: Feb. 8, 2001

(65) Prior Publication Data

US 2001/0025520 A1 Oct. 4, 2001

(30) Foreign Application Priority Data

Feb. 8, 2000 (DE) ..... 100 05 438

(51) Int. Cl.[7] ..... B21B 27/00

(52) U.S. Cl. ..... 72/102; 72/82; 72/84; 72/86; 72/107; 72/120; 29/893.32

(58) Field of Search ..... 72/82, 83, 84, 72/85, 86, 88, 101, 102, 107, 110, 120, 121; 29/893.32

(56) References Cited

U.S. PATENT DOCUMENTS 3,681,962 A * 8/1972 Marcovitch ..... 72/102
5,367,916 A 11/1994 Bevc et al.
6,044,951 A 4/2000 Gutmann et al.
6,076,387 A * 6/2000 Siewert et al. ..... 72/84
6,223,576 B1 * 5/2001 Mashita ..... 72/102
6,279,366 B1 * 8/2001 Sakaguchi ..... 72/102

FOREIGN PATENT DOCUMENTS

DE 2040281 * 3/1971 ..... 72/102
DE 2 254 460 11/1972
DE 198 09 039 A1 9/1999
JP 2-224840 * 9/1990 ..... 72/102

* cited by examiner

*Primary Examiner*—Ed Tolan
(74) *Attorney, Agent, or Firm*—Sughrue Mion, PLLC

(57) ABSTRACT

A method of manufacturing a gearwheel (10) by clutch gear tooth forming with an axial undercut and a roof-shaped entry geometry consists in causing the gearwheel blank to perform a rotating movement and to cause profiled shaping tools in the form of rolls with external toothing, toothed racks or hollow rolls with internal toothing to perform a motion in rolling contact for engagement in the material, and in initiating the corresponding shaping operation by a radial or axial feeding motion, respectively.

13 Claims, 4 Drawing Sheets

METHOD OF AND DEVICE FOR FORMING A CLUTCH GEAR TOOTHING ON GEARWHEELS FOR CHANGE SPEED GEARS

FIELD OF THE INVENTION

The present invention relates to a method of manufacturing the clutch gear toothing on gearwheels in change speed gears (FIG. 1).

Gearwheels having such a clutch gear toothing are employed, for instance, in gear sets for manual shifting. As a rule, they are supported for rotation on the gear shad The transmission of torque from and to the gear shaft is possible only upon axial movement of a shifting sleeve and its engagement in the clutch gear toothing. By means of the undercut on the external toothing the shifting sleeve is prevented from being disengaged when the vehicle is running.

The clutch gear toothings on these gearwheels should generally present a specific geometry for easy engagement of the shifting sleeve as well as an external toothing with axial undercut for reliable torque transmission from and to the shifting sleeve.

PRIOR ART

Several methods are common in engineering for the manufacture of toothing systems having such a geometry. In these methods it is required that, on the one hand, the geometry will be formed on the gear wheel face for permitting easy engagement and that, on the other hand, the axial undercut will be produced to ensure the transmission of torque. It is common in particular to achieve such geometries by a forming operation by cutting, for instance by gear shaping.

A cutting tool such as a pinion-type cutter performs an oscillating motion at a slight angle relative to the longitudinal axis of the gearwheel as well as a feeding motion in a radial direction to the first one. At the same time, the gearwheel and the tool perform a rotating movement so that the required involute shape with undercut will be created when the two bodies move on rolling contact with chip removal.

Another method consists in producing a separate sheet metal disk carrying such a toothing, and in welding this sheet metal disk to the base body of the gearwheel. In such a case the toothing is normally applied by fine pressing.

It is known from the German Patent DE 4335505 C1 to manufacture spur toothings by a rolling operation wherein toothed shaping rolls are axially moved with respect to the rotating work piece, while the shaping rolls are synchronised with the work piece by means of a so-called attachment carrying an external toothing. even though this method is suitable to produce external toothings having tooth traces extending in parallel with the work piece axis it is not appropriate to generate the tooth shape here described.

Another known approach permitting the integral manufacture of the gearwheel in its entirety consists in a calibration of the teeth in a press tool wherein individual toothed quadrants are impressed into the work piece by radial and/or axial movements. Such quadrant tools are not only very complex and highly expensive but have also short service lives. Apart therefrom, it is very difficult with these tools to produce the tooth forming tolerances which are mostly very narrow.

The German Patent DE 22 54 460 discloses a method of and a device for manufacturing clutch gearwheels with engagement securing means. In that method a rolling wheel with a clutch gearwheel is caused to perform a rolling operation, whilst the axes of the rolling wheel and of the clutch gearwheel are aligned in parallel. The shape of the rolling wheel, inclusive of the undercut corresponds to the shape of the toothing to be generated on the gearwheel.

The German Patent DE 198 09 039 A1 equally discloses a method of applying undercuts on individual tooth flanks in an internal toothing on sliding sleeves, In that method the metal material is shaped by way of plastic deformation by rolling on the rear side and/or by pressing so that sub-areas with pull-out preventing function and sub-areas without pull-out preventing faction are pre-shaped on the individual tooth flank to be undercut, and subsequently, when the undercut is generated, some plastified material is urged out of the sections of the sub-areas having a locking function ands pressed into sub-areas without locking function which are configured as recesses of the re-entrant areas.

BRIEF DESCRIPTION OF THE INVENTION

Starting out from the facts that linear press tools are unsuitable for generating the undercut and that quadrant tools are expensive and not precise, the present invention is based on the problem of proposing an economic method and a device permitting the manufacture of high-quality external toothings by non-cutting manufacture, which toothings are suitable to ensure the engagement and disengagement of gear wheels in change speed gears due to a specific lateral entry geometry and an axial undercut, This problem is solved by a method using the features defined in claim 1 or 3 or by a device presenting the features defined in claims 11 or 12. Expedient embodiments are characterised by the remaining claims.

The device comprises a spindle supported for rotation, on which the work piece is clamped by means of a chuck. This spindle is caused to rotate together with the chuck and the work piece.

Shaping tools in the form of rolls with external toothing, toothed racks adapted for linear movement, or hollow internally geared wheels are caused to engage on the work piece and to perform a motion with rolling contact on the work piece. The subsequent movement of these tools towards the work piece at least in a radial direction and possibly also in an axial direction initiates the shaping of a work piece with movement in rolling contact. The axial feed motion or the combined axial/radial feed motion becomes necessary when the axes of rotation of the work piece and of the tool extend in parallel with each other for generating the undercut With this arrangement the rotating movement may be performed by driving the spindle or by driving the shaping tool. What is important is the feed of the shaping tool concurrently with the movement of the tooth profile with rolling contact.

In the present description the term "axial" is to be understood to denote that direction which extends in parallel with the axis of tool rotation along the axis of work piece rotation. In correspondence therewith, a merely radial direction is meant to denote a direction extending radially with respect to the axis of tool rotation. A combined radial and axial direction is correspondingly involved when the tool is moved along a direction towards the axis of work piece rotation that is defined by a purely radial and a purely axial direction.

The present invention is based on the idea of achieving a tooth formation with undercut on a gearwheel by a shaping technique wherein the application of a quadrant tool is avoided. Quadrant tools are inexpedient specifically insofar as a pressing operation with segments is, as a rule, linked up with high tolerances. On the other hand, the undercut renders it impossible to employ common linear presses. At the same time, a specific geometry is to be created on the face of the gearwheel, that permits easy engagement of the shifting sleeve. Such a geometry, that permits an easy engagement, is, for instance, a roof-shaped design of the face or a bow-shaped curvature.

Due to the application of the shaping tool on a feed means in such a way that a combined radial and anal feed motion of the tool will be performed relative to the work piece while the work piece is exposed to a rotating movement at the same time, it is possible to produce a toothing with axially undercut tooth flanks in an axially undercut section of an integral gearwheel. Apart from the rotating movement that is performed by both the work piece and the shaping tool about its respective axis, with these axes extending either in parallel with each other or at an angle a relative to each other, that is wider than 0°, it is essential that the tool feed motion takes place at least in a radial direction. An axial feed motion in addition to the radial movement may be omitted when the axes of rotation of the tool and of the work piece do not extend in parallel with each other. It is moreover possible that the tool performs an additional movement in a direction orthogonal on the plane defined by the axis of rotation and the direction of the feed motion.

It is, of course, possible to use simultaneously several tools having axes of rotation parallel with each other and performing similar feed motions. In the arrangement where the work pieces and the tools present axes of rotation not parallel with each other the axes of rotation of several tools may equally be disposed at an angle. An arrangement as described above permits the production of a gearwheel with an undercut section and axially undercut tooth flanks in the undercut section from one piece by a shaping operation, with a single shaping tool being sufficient on principle for generating the engagement geometries and the undercut external toothing. A toothing with narrow tolerances can hence he provided on a gearwheel subsequently to the formation of a first external toothing by a conventional operation.

In correspondence with a preferred embodiment it is therefore possible to provide at least one further shaping tool on the device in addition to the first shaping tool. This additional shaping tool, which is also referred to as second shaping tool, may serve the purpose of shaping a specific entry geometry, e.g. a roof shape, on the tooth flanks. According to an alternative it is possible, for instance, to support the first shaping tool when the axial undercut and the entry geometry are applied. This specific entry geometry facilitates the engagement of the shifting sleeve. It is, of course, possible to provide not only a single one of these second tools but also several second tools whenever this will be required.

In this embodiment a second tool may be employed together with the first shaping tool or, however, prior or subsequently to this first tool in a chronological order. This results in the fact that when the second shaping tool is used, for instance for setting off an entry geometry, the entry geometry is shaped simultaneously with the shaping of the undercut tooth flanks, or that these operations are performed in different operations in sequential succession. In the course of the shaping operation, the tool or the tools for applying the entry geometry, e.g. the roof shape, perform(s) equally a rotating movement about an axis of rotation. The axis of rotation extends in dependence on the entry geometry, as a rule at an angle relative to the axis of rotation of the gearwheel blank which is wider than 0°. Moreover, the shaping tool performs an additional feed motion that is radial as a rule. In the shaping method for generating the entry geometry furthermore a component of uniform movement along a straight line is part of the feed motion performed by the second shaping tool, which uniform straight movement is performed in parallel with the axis of rotation of the gearwheel blank.

In correspondence with a preferred embodiment, the method of manufacturing the gearwheel with an axially undercut section in which an external toothing presents undercut tooth edges may include the operation of pre-shaping the teeth in the undercut section prior to the final shaping operation. This provision is expedient insofar as with a rough pre-shaping of the toothing the final shaping is less complex and hence takes less time. Apart therefrom, a rough pre-shaping and a subsequent final shaping in the aforedescribed shaping method is, as a rule, less expensive than the final shaping of the toothing in the undercut section from a circular blank that is not pre-shaped.

The device is preferably so designed that a driving means drives the gearwheel blank while the blank is processed. The design is normally made in a way that a clamping fixture is caused to perform a rotating movement and that hence the gearwheel blank clamped on the clamping fixture is carried along in this movement. When the clamping fixture is driven it is possible for the gearwheel blank to induce a parallel passive movement of the tool or tools by a movement with rolling contact. It is therefore not necessary to provide an independent drive for the tools, at least as far as the rotating movement of the tools is concerned. The tools or the feed means on which the tools are fastened must, however, be capable of performing the at least radial and possibly also axial feed motion that is required in the inventive method On the other hand, in accordance with another expedient embodiment, a driving means is provided for the shaping tool or tools. Here two possibilities are conceivable on principle, specifically fly that the driving means are provided for the shaping tools in addition to the driving means for the clamping fixture and hence for the work piece, or secondly that the driving means are provided for the shaping tool or the shaping tools, without the provision of a driving means for the clamping fixture. In the first case, a synchronising means is provided in an additional expedient manner, that permits and ensures the rotational movements of the tools ands the gearwheel blank in mutual synchrony. In the other case, the work piece may be passively carried along due to a movement in rolling contact between the tool and the work piece. Two separate driving means entail the advantage that the feed means may be driven via the same driving means for performing the feed motion. In this case, however, it is necessary to ensure the synchronised rotational movement between the work piece and the tool. When either the tool or the work piece is passively carried along by the respectively other element there is no longer the necessity to provide a synchronising means.

The fist shaping tool is expediently a roll provided with an external profile. The external profile is designed as counterpart matching with the desired toothing profile. A profiled tooth forming roll is firstly easy to manufacture and secondly easy to mount in an appropriate fixture. When a profiled roll is employed, that is also known as toothing roll, it is additionally possible to mount simultaneously a second shaping tool, e.g. for the generation of an entry geometry, possible also in the form of a profiled roll and to process the work piece with booth tools at the same time. The axis of rotation of the roll or rolls, respectively, may extend either in parallel or at an angle relative to the axis of rotation of the work piece.

In correspondence with another preferred embodiment, the first shaping tool is a hollow roll. In this case, the hollow roll presents a profile on its internal surface to make sure that the corresponding desired toothing is pressed into the gearwheel blank. When a hollow roll is employed it is not possible, however, to process the work piece simultaneously with a seconds tool, Moreover, it is inexpedient in the case of application of a hollow roll to mount several first tools, which takes an influence on the time consumed for processing. With a hollow roll it is expediently possible to generate an entry geometry by arrangement of the axes of the work piece and the tool when the axes do not extend in parallel with each other.

Whilst both the hollow roll with a profile on its internal periphery and the rotating rolls with a profile on their external periphery perform, in shaping, a rotating movement about an axis parallel with the axis of rotation of the gearwheel blank the movement of the tool is a substantially linear oscillating movement when profiled toothed racks are expedient insofar as they are very easy to produce at low costs. In such a case the axis of rotation of the tool is replaced by the direction of the uniform displacement of the toothed rack along a straight line.

BRIEF DESCRIPTION OF THE DRAWINGS

The invention will be descended by exemplary embodiments in the following, with reference to the attached figures wherein.

WAYS OF IMPLEMENTING THE INVENTION

Figure 1:
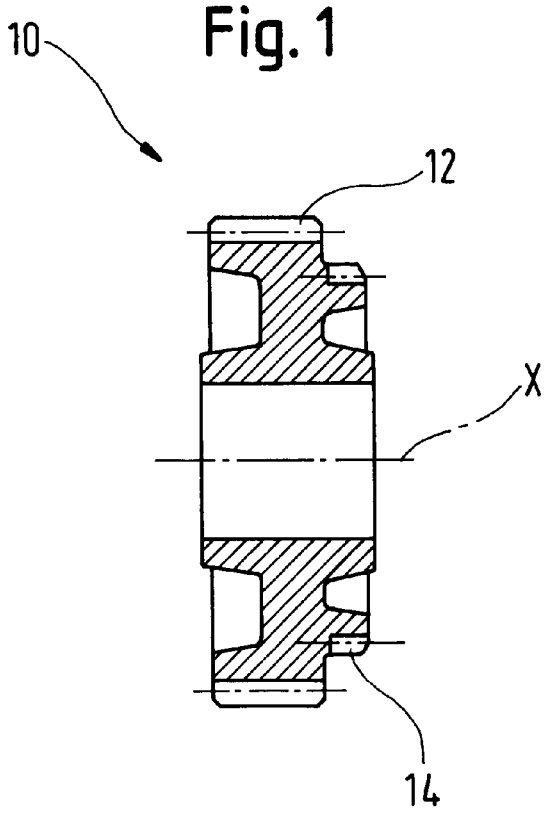
FIG. 1 shows a cross-sectional view of a gearwheel pressing a roof-shaped entry geometry and an axial undercut.

FIG. 1 shows a cross-sectional view taken through an integral gearwheel having an integrated clutch gear toothing. (14).

Figure 2:
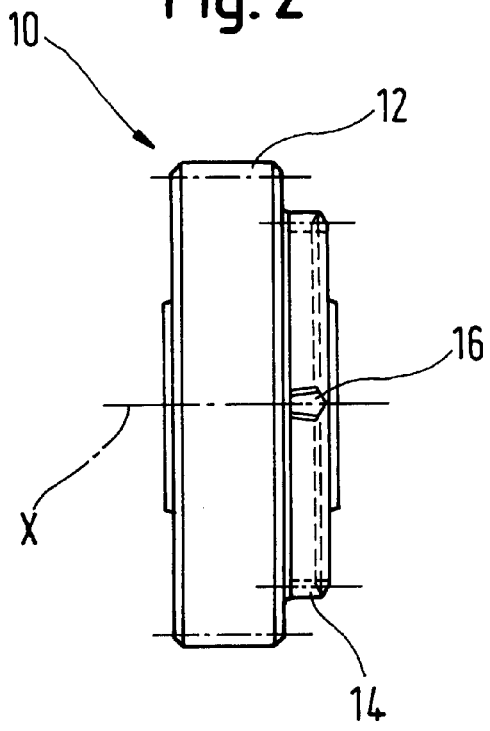
FIG. 2 is a side view of an integral gearwheel presenting an axially undercut toothing.

In the side view of FIG. 2 the shape of a tooth in such a clutch gear toothing can be clearly seen. The roof shape pointing to the right side permits the engagement of the shifting sleeve. The tooth (undercut) tapers towards the left side, thus permitting the safe retention of the shifting sleeve with the vehicle running. The terms "right" and "left" refer to the figures and are to be understood merely in an illustrative sense rather than with a restricting meaning.

Figure 3:
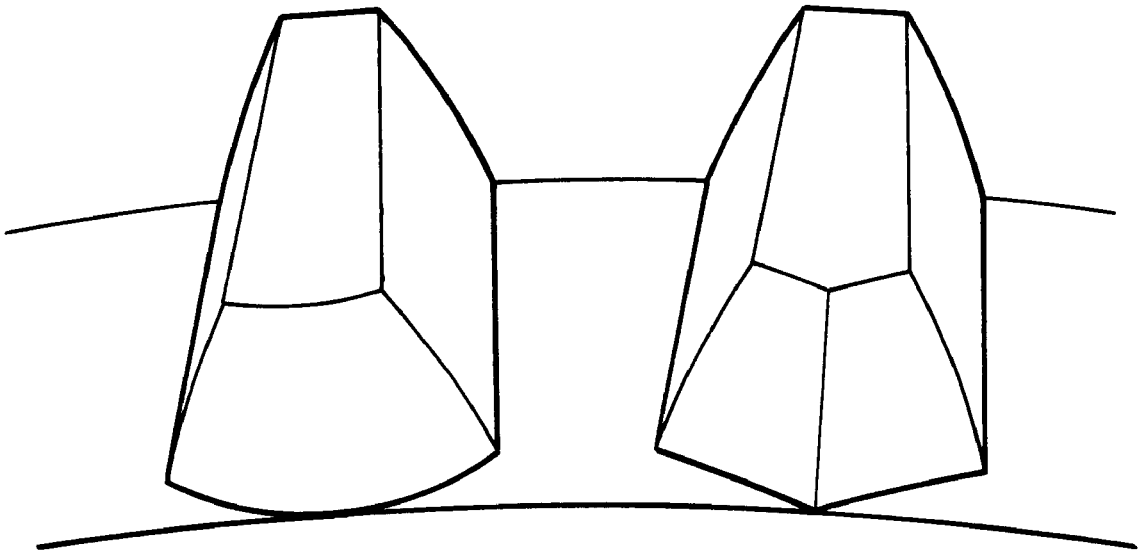
FIG. 3 shows illustrations of two different entry geometries on an undercut toothing.

FIG. 3 shows an enlarged view of the shape of a tooth in a clutch gear toothing wherein the tooth is tapered. Two different entry geometries are illustrated, specifically one rounded tooth face and a roof-shaped tooth face.

Figure 4:
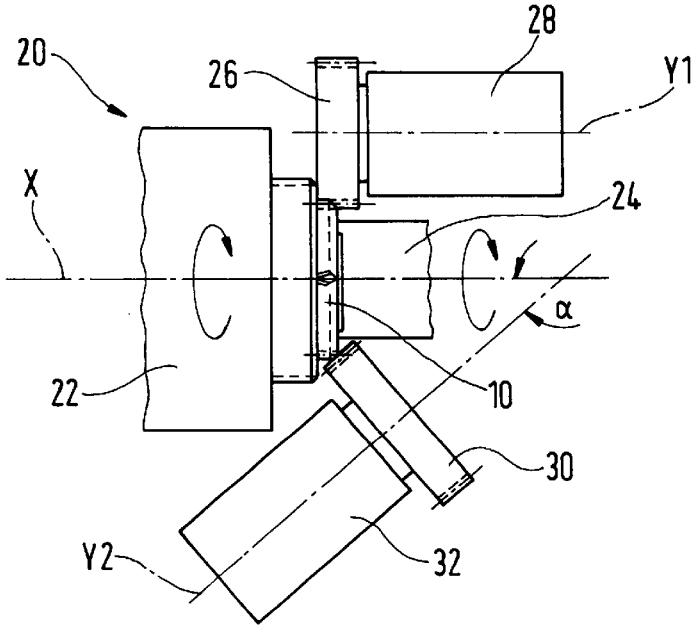
FIG. 4 is a view of a device for manufaturing an integral gearwheel having an integrated clutch gear toothing in accordance with the present invention.

FIG. 4 illustrates an exemplary embodiment of a device for forming a gearwheel presenting the geometric configuration as illustrated in FIGS. 1 and 2. The device comprises a spindle 22 supported for rotation about the axis X and a tailstock 24, which parts co-operate to constitute a clamping fixture that is used to clamp the gearwheel blank 10. A first tool 26 is supported by means of a roller seating means for rotation about an axis Y1. With a feed means not illustrated here it is possible to move this assembly radially with respect to the work piece. The bus Y1 extends substantially in parallel With the axis of rotation X. The tool 26 is configured as roll presenting a profile on the external periphery that is suitable for forming the external toothing on the work piece, particularly the undercut section thereof.

FIG. 4 moreover shows a second tool 30 that is supported on the roller seating means 32 and provided with a feed means not illustrated here. The axis of rotation of this tool is disposed at an angle $\alpha$ relative to the axis of rotation of the spindle. It is possible to drive the work piece and the tools to perform a rotating movement both by means of a driven spindle and via driven tools.

In the illustrated embodiment a first shaping tool and a second shaping tool are provided. Depending on the specified tooth geometry it may be possible to use several tools of the first or the second type or to employ only one tool of the first or the second type.

In the embodiment illustrated in FIG. 4 both tools are configured as rolls presenting an external profile. It is equally possible, of course, to use also other suitable tools. Examples of such tools are shown in FIGS. 5 to 7.

Figure 5:
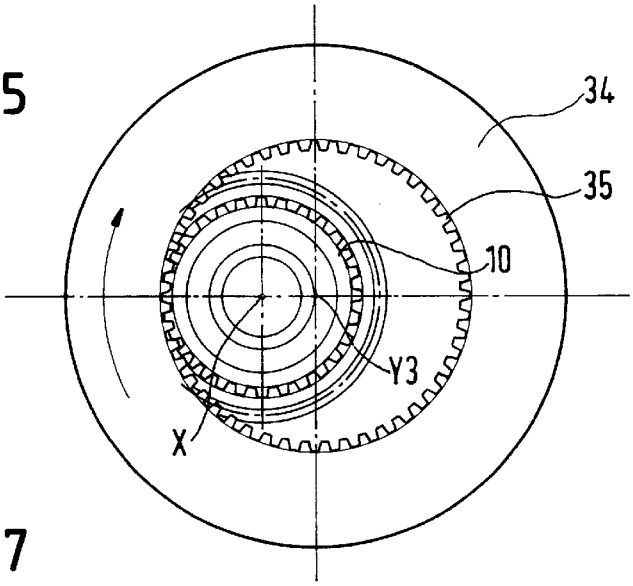
FIG. 5 illustrates a shaping tool in correspondence with one embodiment of the present invention.
Figure 6:
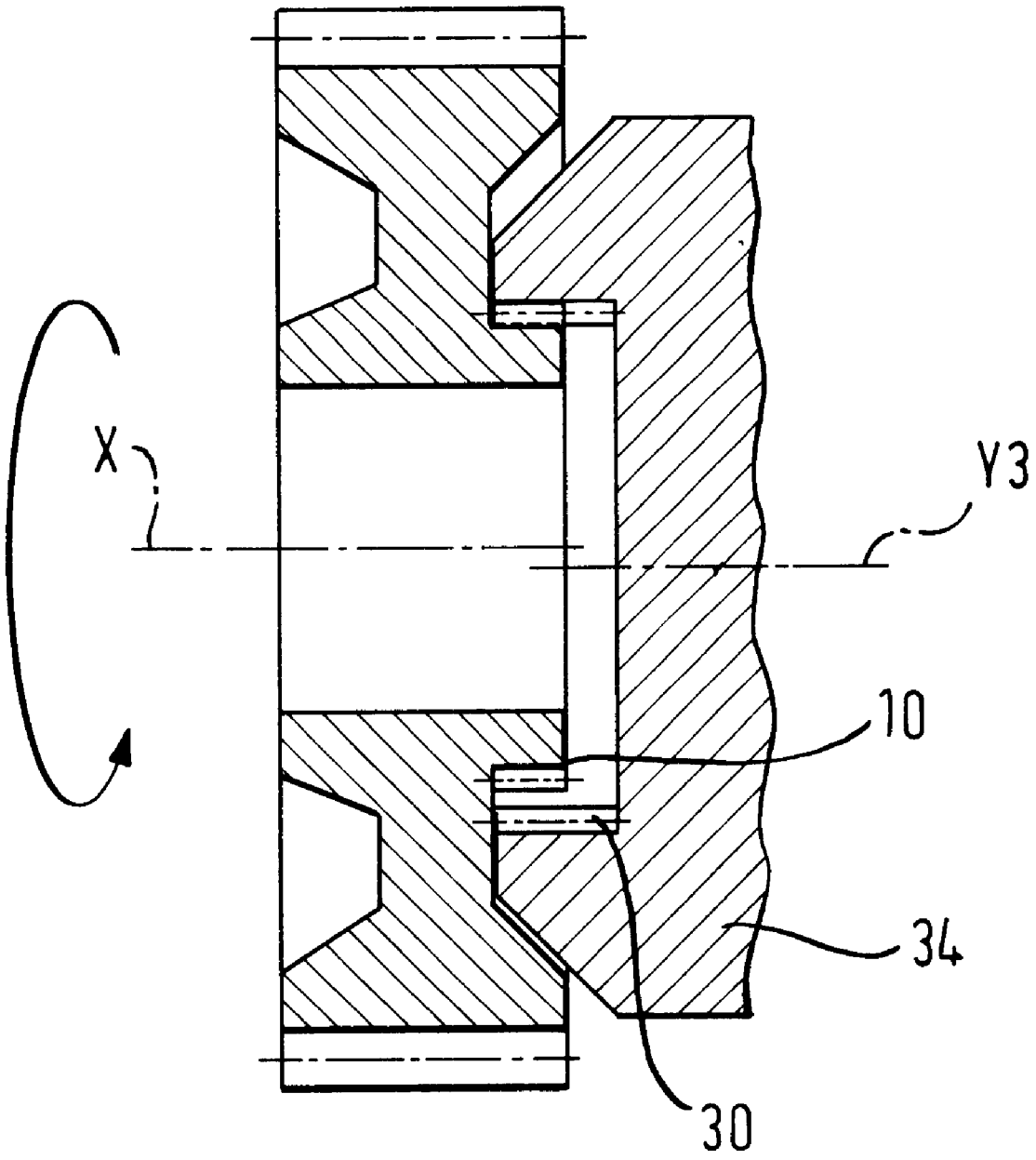
FIG. 6 is a cross-sectional view of the tool according to FIG. 5.

FIGS. 5 and 6 illustrate an internally geared wheel that performs a rotating movement about an axis of rotation Y3 extending in parallel with the axis of rotation of the work piece X. According to an alternative it is also possible that the axes of rotation are disposed at an angle of $0° < \alpha < 360°$ relative to each other.

The internally geared wheel 34 presents a profile 35 on its internal periphery that contributes substantially to the effect that the desired toothing is generated on the work piece 10 by shaping. In this case, the feed motion is essentially performed along a radial direction relative to the axes of rotation X or Y3, respectively.

Figure 7:
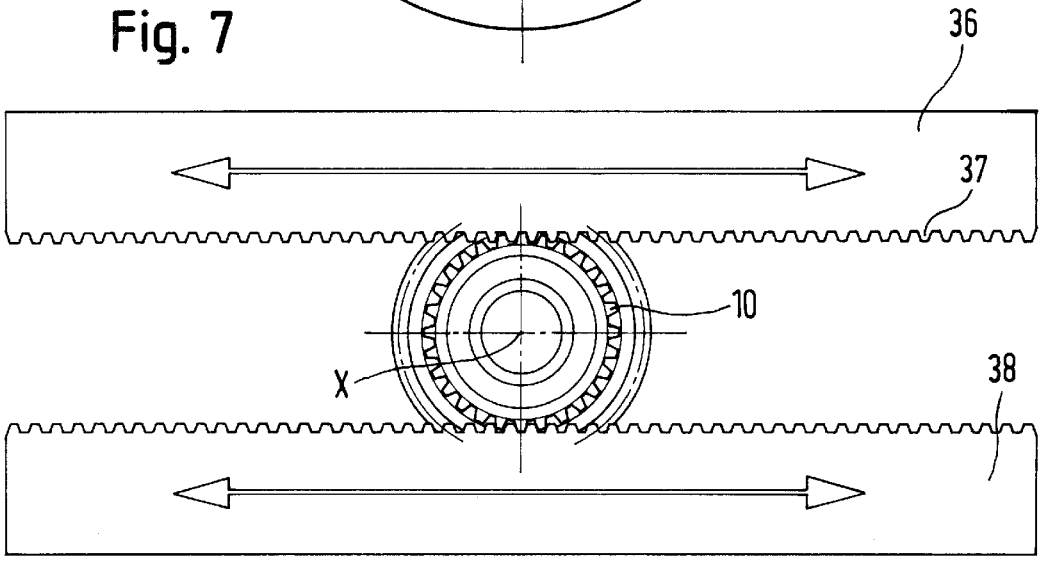
FIG. 7 shows an embodiment of the shaping tool with toothed racks.

FIG. 7 illustrates another embodiment of one part of the inventive device. What is illustrated here is a tool 36 designed in the form of a toothed rack. This rack carries out a linear oscillating movement, with the vectors of motion being contained in a plane extending substantially orthogonally on the axis of rotation X of the gearwheel blank j10. Due to the rotating movement of the gearwheel blank with a simultaneous linear movement of the tooth rack, in combination with a simultaneous radial feed of the tooth rack towards the work piece an operation is achieved that performs shaping in rolling contact with the formation of the teeth.

It is possible to use a second toothed rack 38 opposite the first rack for supporting the work piece and for increasing the production efficiency.

The essential aspect of the inventive method and of the inventive device resides in the fact that by a movement of a profiled tool in rolling contact with a simultaneous radial feed the tooth shape with oblique entry surface and undercut, that is required for change speed gears, can be manufactured at low cost with application of simple tools,

What is claimed is:

1. Method of manufacturing an external toothing on a work piece supported for rotation, comprising:

the generation of an external toothing with an axial undercut on the work piece by shaping, wherein at least one profiled shaping tool performs a movement in rolling contact relative to said work piece and a combined radial and axial feeding motion relative to said work piece while and axis of rotation of said work piece and an axis of rotation of said tool form an angle of $0<\alpha<360°$ relative to each other.

2. Method according to claim 1, further comprising the step of applying an entry geometry on a face of said work piece by shaping.

3. Method according claim 2, characterized in that said shaping tool for producing said undercut is the same as the tool for producing the entry geometry.

4. Method according to claim 2, characterized in that said shaping tool is provided for producing the entry geometry.

5. Method according to claim 2, characterized in that the entry geometry is a roof shape or a curvature.

6. Method according to claim 1, wherein said work piece is a blank having a circular cross-section or presents pre-shaped teeth having an axially constant cross-section.

7. Method according to claim 1, characterized in that in that a shaping tool is a profiled roll, a hollow roll or a toothed rack.

8. Device for forming a clutch gear toothing on a work piece, wherein the forming is performed by shaping, comprising:

a clamping fixture (22, 24) for supporting a work piece blank for rotation about an axis of rotation (X);

at least one feeding means for applying at least one shaping tool (26), which means is suitable to perform at least a combined radial and axial feeding motion relative to the axis of rotation (X) of said clamping fixture;

a least a first shaping tool (26) for shaping the toothing in an undercut section of said work piece; and at least one driving means for rotating said work piece and/or said tool.

9. Device according to claim 8, further comprising:

at least one further feeding means for applying at least one further shaping tool (30), which means is suitable to perform a radial and axial feeding motion relative to the axis of rotation (X) of said clamping fixture;

at least one second shaping tool (30) for shaping a round or roof-shaped entry geometry on said work piece.

10. Device according to claim 8, characterized in that a driving means drives said gearwheel blank (10).

11. Device according to claim 8, characterized in that said driving means drives said shaping tool(s) (26,30).

12. Device according to claim 10, further comprising a means for synchronizing said driving means.

13. Device according to claim 8, characterized in that said first shaping tool(s) (26) and/or said second shaping tool(s) (30) is/are at least one profiled roll, hollow roll or toothed rack.

* * * * *

UNITED STATES PATENT AND TRADEMARK OFFICE

CERTIFICATE OF CORRECTION

PATENT NO. : 6,494,072 B2
DATED : December 17, 2002
INVENTOR(S) : Uwe Tittmann

It is certified that error appears in the above-identified patent and that said Letters Patent is hereby corrected as shown below:

Title page,
Item [73], Assignee, should read as follows:
-- [73] Assignee: PSW Press-und Schmiedewerk GmbH, Brand-Erbisdorf (DE) --

Signed and Sealed this

Third Day of June, 2003

JAMES E. ROGAN
*Director of the United States Patent and Trademark Office*